US007088213B2

(12) United States Patent
Chien et al.

(10) Patent No.: US 7,088,213 B2
(45) Date of Patent: Aug. 8, 2006

(54) TRANSFORMER AND LAMP SYSTEM UTILIZING THE SAME

(75) Inventors: Cheng-Hsien Chien, Taoyuan (TW); Ching-Fu Hsueh, Bade (TW)

(73) Assignee: Darfon Electronics Corp., Kweishan Taoyuan (TW)

( * ) Notice: Subject to any disclaimer, the term of this patent is extended or adjusted under 35 U.S.C. 154(b) by 105 days.

(21) Appl. No.: 10/896,830

(22) Filed: Jul. 22, 2004

(65) Prior Publication Data

US 2005/0017658 A1 Jan. 27, 2005

(30) Foreign Application Priority Data

Jul. 25, 2003 (TW) ..... 92120337 A

(51) Int. Cl.
*H01F 27/28* (2006.01)

(52) U.S. Cl. ..... 336/182; 336/180; 336/212; 336/208

(58) Field of Classification Search ..... 336/180, 336/182, 212, 208, 198, 192
See application file for complete search history.

(56) References Cited

U.S. PATENT DOCUMENTS 6,611,190 B1 * 8/2003 Chui et al. ..... 336/198

FOREIGN PATENT DOCUMENTS

TW 478292 3/2002

* cited by examiner

*Primary Examiner*—Anh Mai
(74) *Attorney, Agent, or Firm*—Thomas, Kayden, Horstemeyer & Risley

(57) ABSTRACT

A transformer for a lamp system. A first spindle comprises a first hollow portion. A second spindle comprises a second hollow portion and is arranged in parallel with the first spindle. A first coil is wound around the first spindle. Second coils are wound around the second spindle. The number of second coils is even. Windings of the second coils are approximately equal. The core module is disposed in the first and second hollow portions.

5 Claims, 9 Drawing Sheets

TRANSFORMER AND LAMP SYSTEM UTILIZING THE SAME

BACKGROUND

The present invention relates to a transformer, and more particularly to a transformer for a lamp system.

FIG. 1 is a schematic diagram of a conventional lamp system. A transformer 12 converts power supplied by a driving circuit 10 into power supply required by lamps L1~LN. Each capacitor C1~CN is coupled between the transformer 12 and one of lamps L1~LN. Each lamp generates a different level of illumination due to various current levels supplied by the transformer 12.

A conventional solution adds a balance circuit.

FIG. 2 is a schematic diagram of another convention lamp system as disclosed in Taiwan patent No. 478292, adding a balance circuit 14 between the lamps L1~LN and capacitors C1~CN, such that each lamp L1~LN receives the same current. Although, with this method, each lamp generates the same level of illumination, the circuit of the lamp system becomes complicated and costly.

SUMMARY

An embodiment of the present invention provides a transformer comprising first and second spindles, a first coil, second coils, and a core module. The first spindle comprises a first hollow portion. The second spindle, arranged parallel to the first spindle comprises a second hollow portion. The first coil is wound around the first spindle. Each second coil is wound around the second spindle. Windings of the second coils are approximately equal. The core module is disposed in the first and second hollow portions.

An embodiment of the present invention also provides a lamp system comprising a plurality of lamps, a driving circuit, and a transformer. The transformer is coupled between the lamps and the driving circuit and comprises first and second spindles, a first coil, second coils, and a core module. The first spindle comprises a first hollow portion. The second spindle arranged parallel to the first spindle comprises a second hollow portion and. The first coil is wound around the first spindle and coupled to the driving circuit. Each second coil coupled to at least one lamp is wound around the second spindle. Windings of the second coils are approximately equal. The core module is disposed in the first and second hollow portions.

BRIEF DESCRIPTION OF THE DRAWINGS

The present invention can be more fully understood by reading the subsequent detailed description and examples with reference made to the accompanying drawings, wherein.

DETAILED DESCRIPTION

First Embodiment

Figure 1:
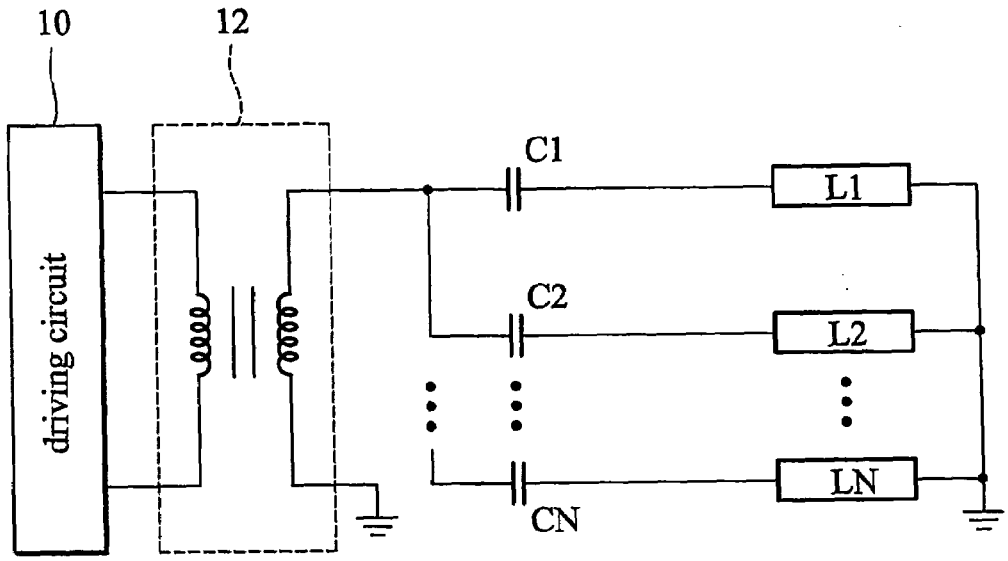
FIG. 1 ( RELATED ART )
FIG. 1 is a schematic diagram of a conventional lamp system.
Figure 2:
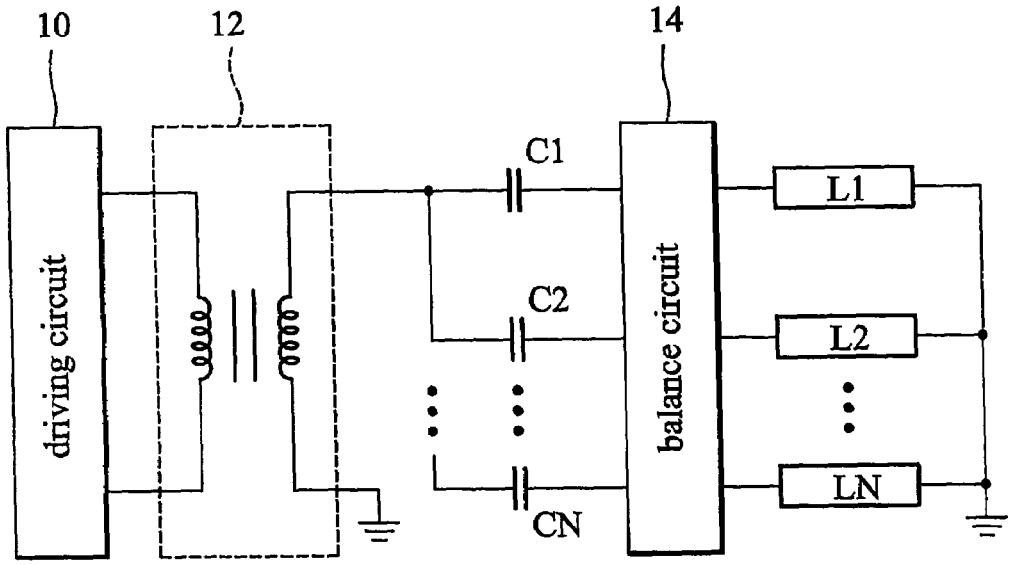
FIG. 2 ( RELATED ART )
FIG. 2 is a schematic diagram of another convention lamp system as disclosed in Taiwan patent No. 478292.
Figure 3:
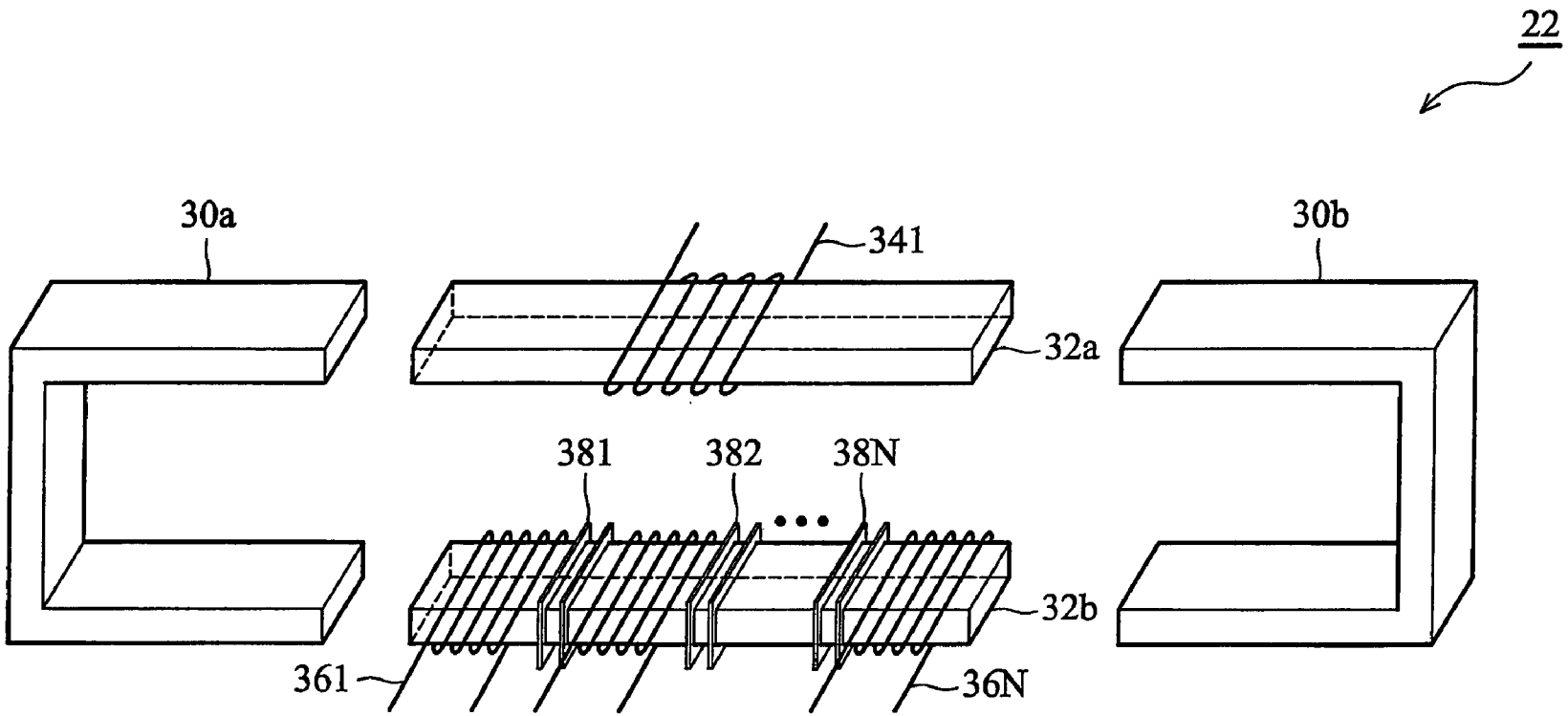
FIG. 3 is a schematic view of a transformer according to a first embodiment of the present invention.

FIG. 3 is a schematic view of a transformer according to a first embodiment of the present invention. The transformer 22 comprises spindles 32*a* and 32*b*, coils 341 and 361~36N, and a core module comprising cores 30*a* and 30*b*. The spindle 32*a* comprises a first hollow portion. The spindle 32*b* comprises a second hollow portion. The coil 341 is wound around the spindle 32*a*. The number of the coils 361~36N is even. Windings of the coils 361~36N are approximately equals. Each of the coils 361~36N is wound around the spindle 32*b*. The cores 30*a* and 30*b* are disposed in the first hollow portion of the spindle 32*a* and the second hollow portion of the spindle 32*b*.

In this embodiment, the cores 30*a* and 30*b* are U-shaped. Thus, the spindle 32*b* is arranged in parallel with the spindle 32*a*. However, various shapes or structures of the cores 30*a* and 30*b* can be applied. For example, an L-L structure constituting by two L-shaped cores, a U-I structure constituting by a U-shaped core and an I-shaped core, or other core structures with two core portions arranged in parallel are also acceptable.

The spindles 32*a* and 32*b* are mounted on a base plate or mutually independent. In this embodiment, 32*a* and 32*b* are two independent spindles. Each pair coils 361~36N are spaced a specific distance apart. Each partition 381~38N is disposed between each pair of coils 361~36N.

Second Embodiment

Figure 4:
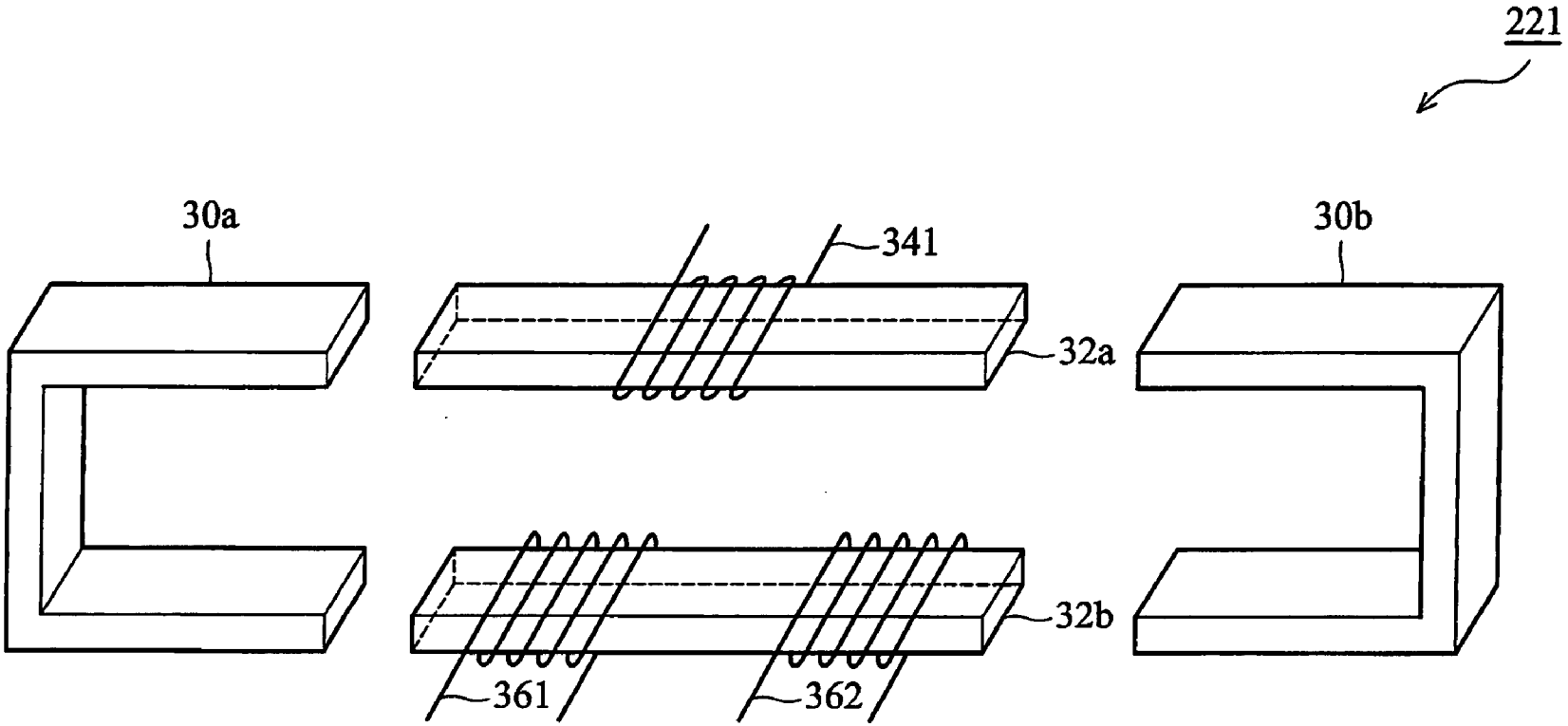
FIG. 4 is a schematic view of another transformer according to a second embodiment of the present invention.

FIG. 4 is a schematic view of another transformer according to a second embodiment of the present invention. FIG. 4 is similar to FIG. 3 except that only two coils 361 and 362 are wound around the spindle 32*b* in FIG. 4.

Figure 5:
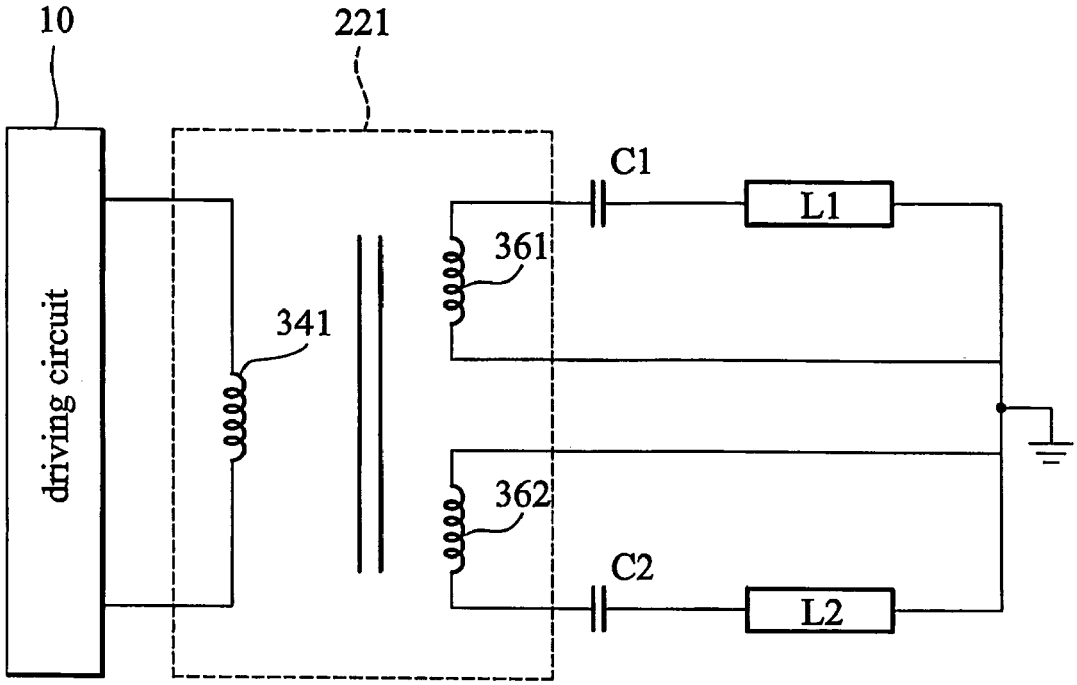
FIG. 5 is a schematic view of a lamp system utilizing the transformer in FIG. 4.

FIG. 5 is a schematic view of a lamp system utilizing the transformer 221 in FIG. 4. The transformer 221 is coupled between driving circuit 10 and lamps L1 and L2. The coil 341 is coupled to driving circuit 10 to receive driving power. The same polarity terminals of the coils 361 and 362 are coupled to ground since the lamp system is in a common ground connection. The other terminals of the coils 361 and 362 are respectively coupled to the lamps L1 and L2, which have terminals coupled to ground. The lamp system further comprises a capacitor C1 coupled between the coil 361 and lamp L1, and a capacitor C2 coupled between the coil 362 and lamp L2.

The second coils 361 and 362 carry substantially the same magnetic flux. According to Lenz's Law and Faraday's law of electromagnetic induction, the coils 361 and 362 provide substantially the same current to lamps L1 and L2, rendering substantially the same level of illumination for each lamp. The voltage difference between coils 361 and 362 is lower since the lamp system is in a common ground connection. Thus, the spindle 32*b* needs no partition for coils 361 and 362.

Figure 6:
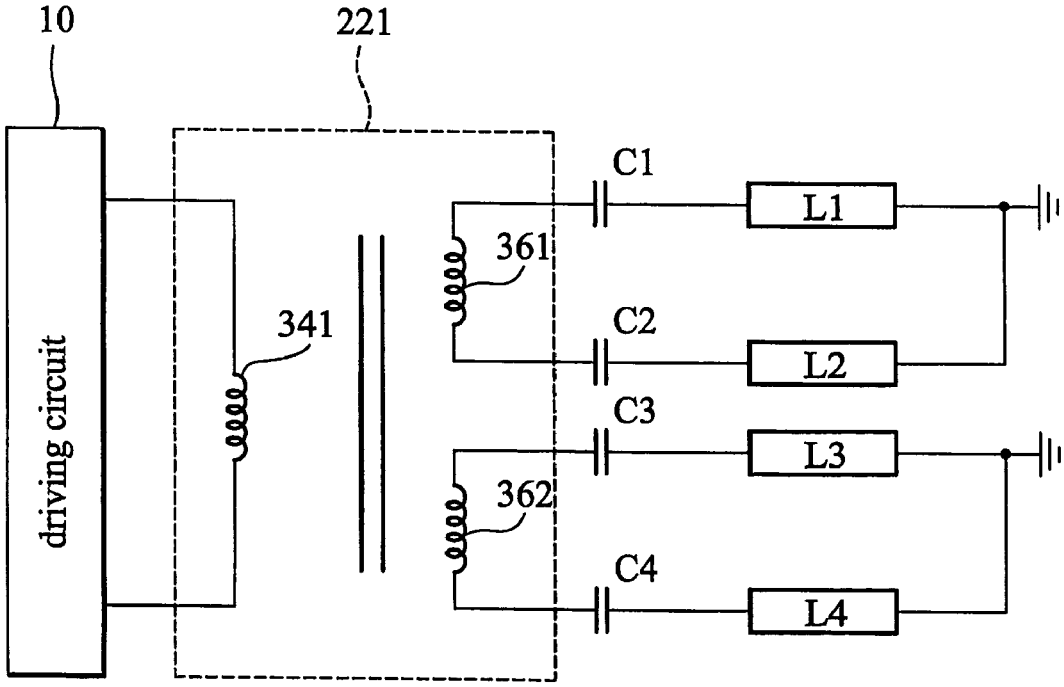
FIG. 6 is a schematic view of another lamp system utilizing the transformer in FIG. 4.

FIG. 6 is a schematic view of another lamp system utilizing the transformer 221 in FIG. 4. FIG. 6 is similar to FIG. 5 except that the transformer 221 in FIG. 6 drives four lamps L1~L4. The coil 361 is coupled to the lamps L1 and L2. The coil 362 is coupled to the lamps L3 and L4. Each capacitor C1~C4 is respectively coupled between one lamp and one coil. Since the lamp system is in a series connection, voltage difference between coils 361 and 362 is higher, easily causing sparking between coils 361 and 362. Thus, the coils 361 and 362 are spaced a specific distance apart and a partition is added between the coils 361 and 362. The coils 361 and 362 always have substantially the same magnetic flux. According to Lenz's Law and Faraday's law of electromagnetic induction, coils 361 and 362 provide substantially the same current to lamps L1~L4, rendering substantially the same level of illumination for each lamp.

Third Embodiment

Figure 7:
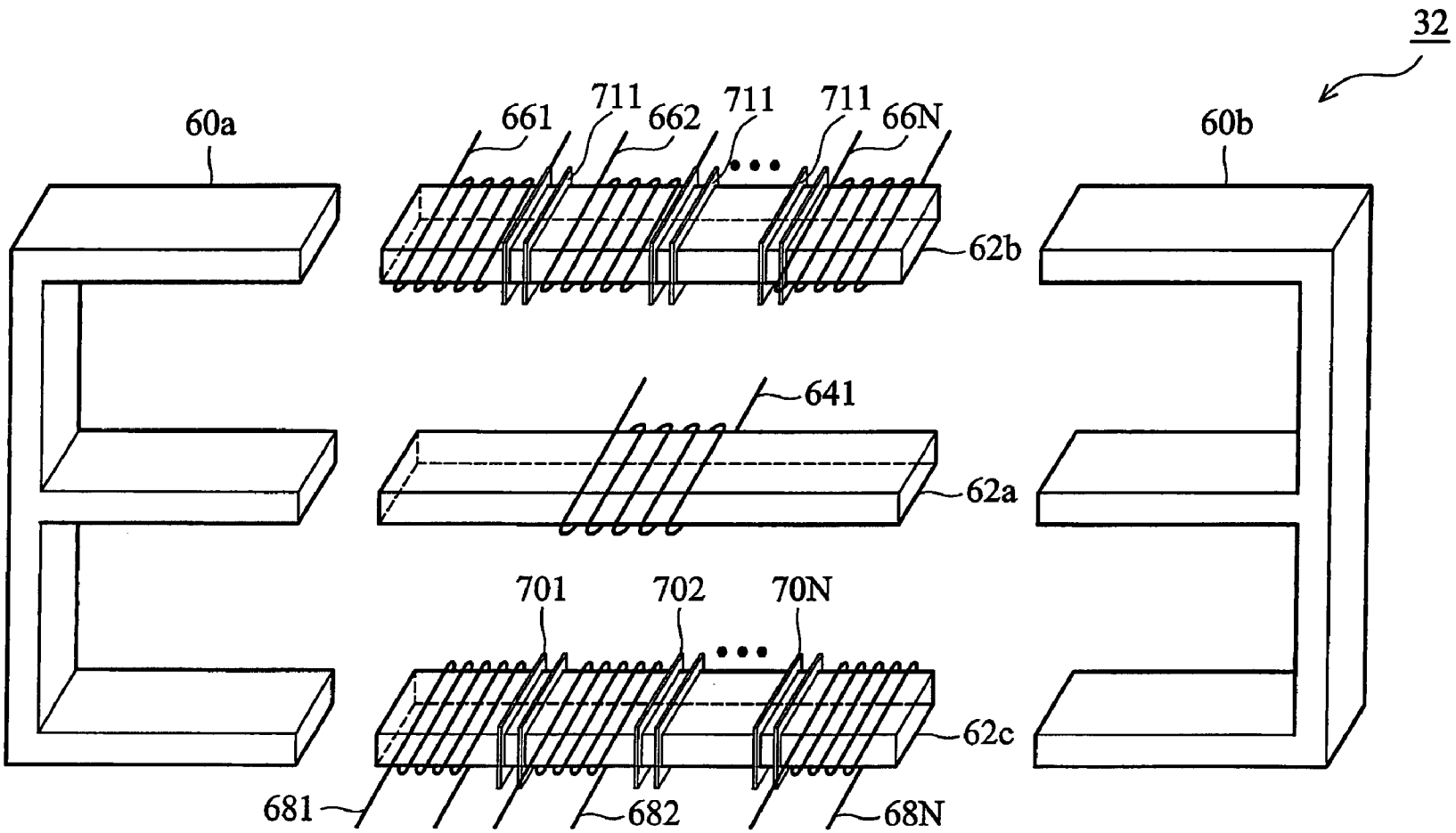
FIG. 7 is a schematic view of a transformer according to a third embodiment of the present invention.

FIG. 7 is a schematic view of a transformer according to a third embodiment of the invention. The transformer 32 comprises spindles 62*a*, 62*b*, and 62*c*, coils 641, 661~66N, and 681~68N, and a core module comprising cores 60*a* and 80*b*. The spindle 62*a* comprises a first hollow portion. The spindle 62*b* comprises a second hollow portion. The spindle 62*c* comprises a third hollow portion. The coil 641 is wound around the spindle 62*a*. The numbers of coils 661~66N and 681~68N are even. Windings of the coils 661~66N are approximately equal. The coils 661~66N are wound around the spindle 62*b*. The coils 681~68N are wound around the spindle 62*c*. Windings of the coils 681~68N are approximately equal. The cores 60*a* and 60*b* are disposed in the first, second, and third hollow portions. In this embodiment, the core module comprises two E-shaped cores 60*a* and 60*b*. Thus spindles 62*b* and 62*c* is arranged parallel to the spindle 32*a*. Various shapes or structures of the core module can also be applied to the embodiment, such as an E-I structure constituting by an E-shaped core and an I-shaped core, or a U-T structure constituting by a U-shaped core and a T-shaped core.

The spindles 62*a*, 62*b*, and 62*c* are mounted on a base plate or mutually independent. In this embodiment, the spindles 62*a*, 62*b*, and 62*c* are mutually independent.

Spindle 62*b* comprises partitions 711~71N and spindle 62*c* comprises partitions 701~70N. Each pair coils 661~66N are spaced a specific distance apart. Each partition 711~71N is disposed between each pair of coils 661~66N. Each pair coils 681~68N are spaced the specific distance apart. Each partition 701~70N is located between each pair of coils 681~68N.

Fourth Embodiment

Figure 8:
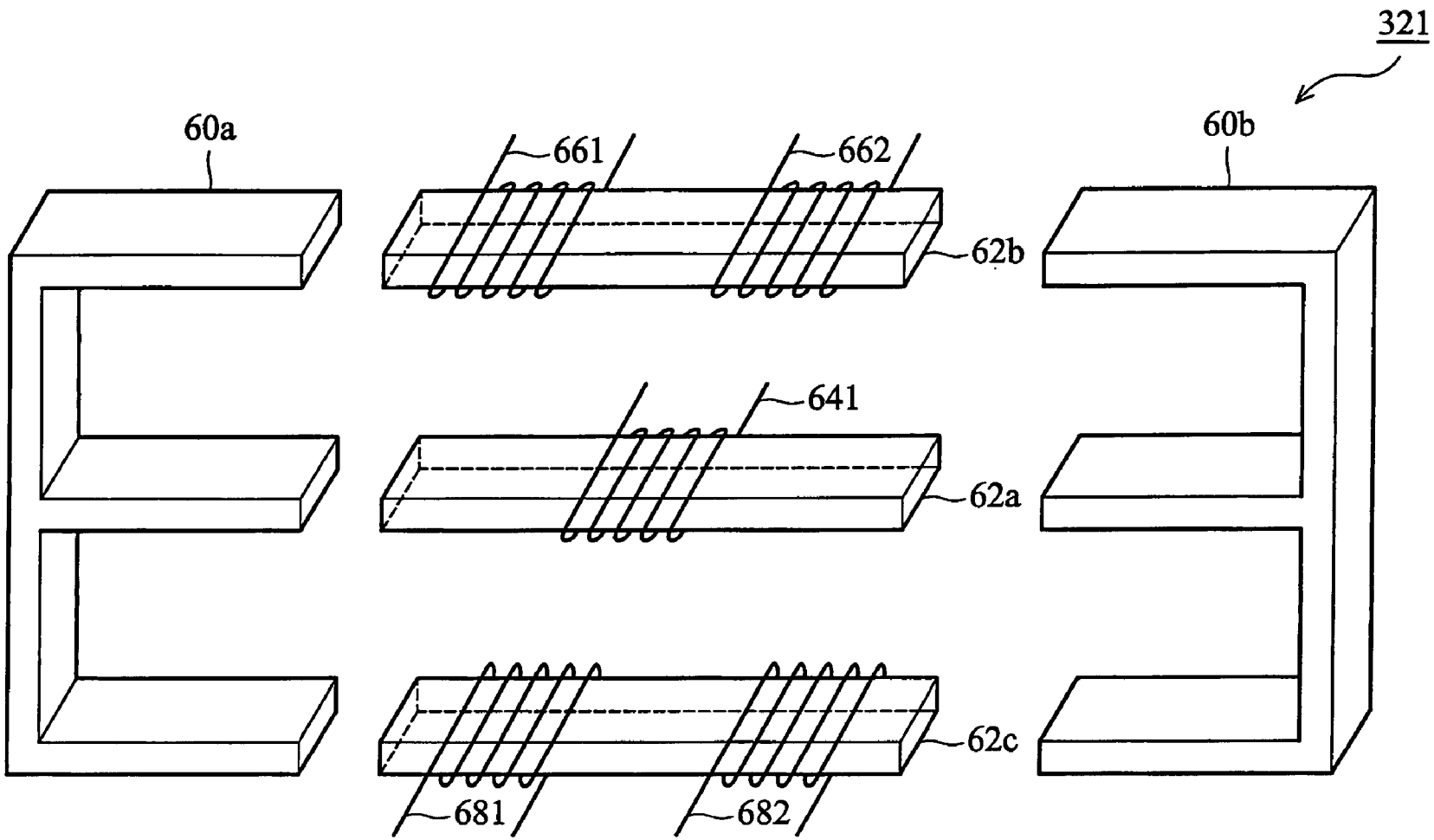
FIG. 8 is a schematic view of another transformer according to a fourth embodiment of the present invention.

FIG. 8 is a schematic view of another transformer according to a fourth embodiment of the invention. FIG. 8 is similar to FIG. 7 except that only two coils 661 and 662 are wound around the spindle 62*b*, and only two coils 681 and 682 are wound around the spindle 62*c* in FIG. 8.

Figure 9:
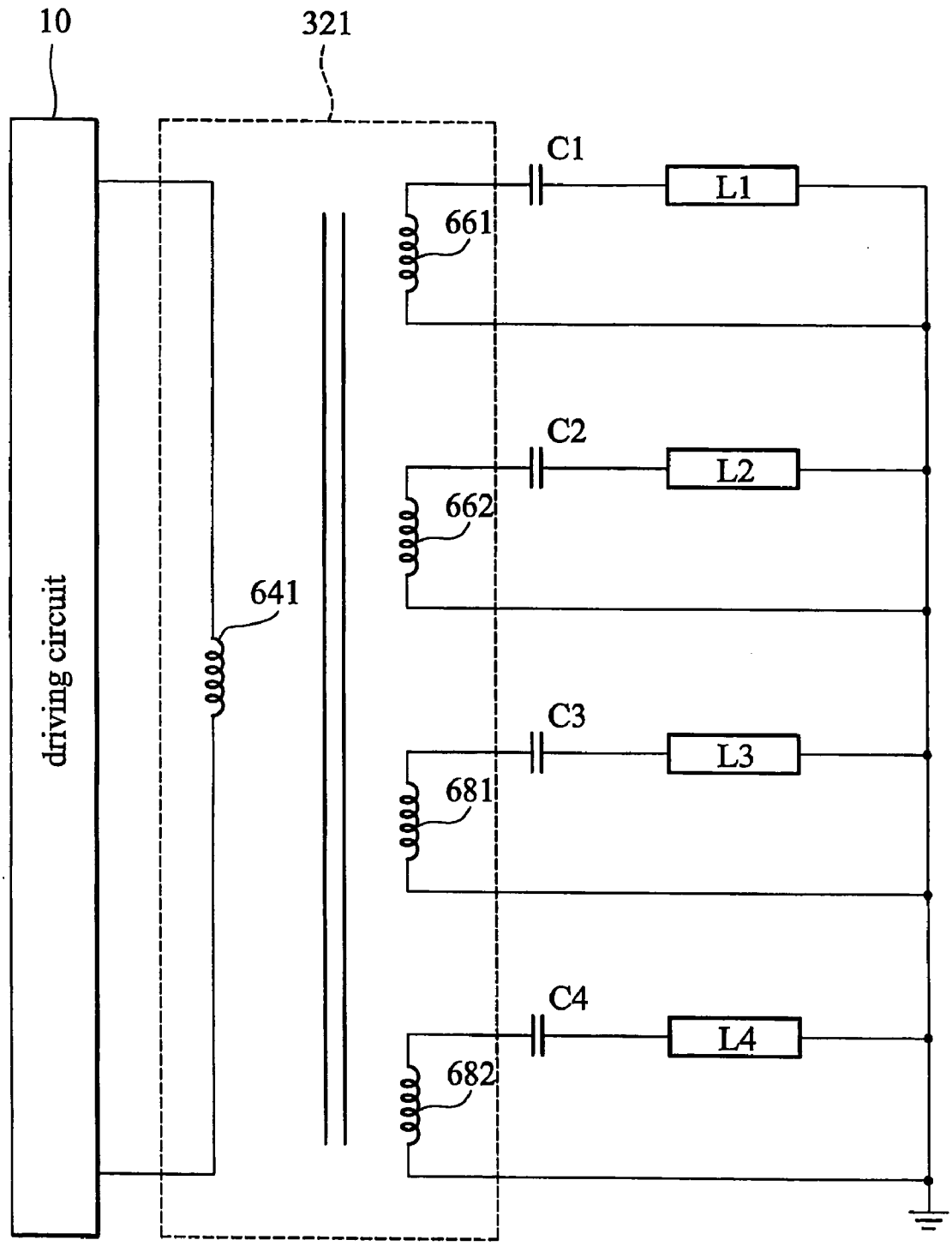
FIG. 9 is a schematic view of a lamp system utilizing the transformer in FIG. 8.

FIG. 9 is a schematic view of a lamp system utilizing the transformer 321 in FIG. 8. The transformer 321 is coupled between driving circuit 10 and lamps L1~L4. The coil 641 of the transformer 321 is coupled to driving circuit 10 for receiving driving power.

Each of coils 661~662 and 681~682 has a terminal coupled to ground since the lamp system is in a common ground connection. The ungrounded terminals of the coils 661~662 and 681~682 are respectively coupled to lamps L1~L4. Other terminals of lamps L1~L4 are coupled to ground. The lamp system further comprises capacitors C1~C4. Each capacitor C1~C4 is coupled between one coil and one lamp.

The coils 661~66N and 681~68N have substantially the same magnetic flux. According to Lenz's Law and Faraday's law of electromagnetic induction, the coils 661~66N and 681~68N provide substantially the same current to lamps, rendering substantially the same level of illumination for each lamp.

Figure 10:
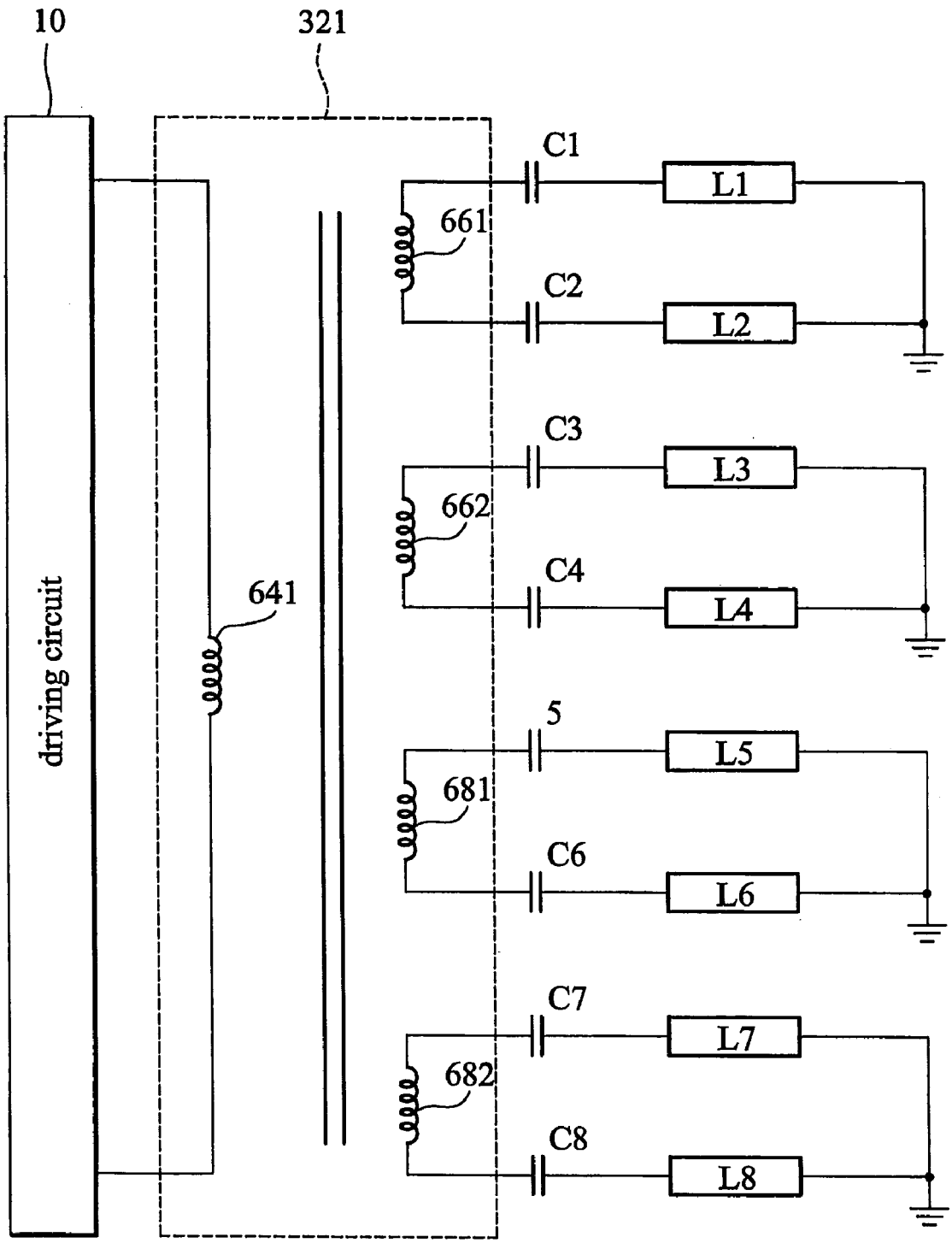
FIG. 10 is a schematic view of another lamp system utilizing the transformer in FIG. 8.

FIG. 10 is a schematic view of another lamp system utilizing the transformer 321 in FIG. 8. FIG. 10 is similar to FIG. 9 except that the lamp system in FIG. 10 is in a serial connection. The coils 661 and 662 are coupled to lamps L1~L4. The coils 681 and 622 are coupled to lamps L5~L8. One capacitor is coupled between one coil and one lamp.

As shown in FIG. 9, when the lamp system is in a common ground connection, the lamp system can drive four lamps. As shown in FIG. 10, when the lamp system is in a serial connection, the lamp system can drive eight lamps. Windings of the coils 661 and 662 substantially equal that of the coils 681 and 682. According to Lenz's Law and Faraday's law of electromagnetic induction, the coils 661~662 and 681~682 provide substantially the same current to lamps L1~L8, rendering substantially the same level of illumination for each lamp.

Additionally, the coils 341 and 641 are respectively wound around the spindles 32*a* and 62*a* and may be formed by any available winding method. Different winding methods may provide better current balance effect for the transformer. A first winding method is shown in FIGS. 3 and 7.

Figure 11:
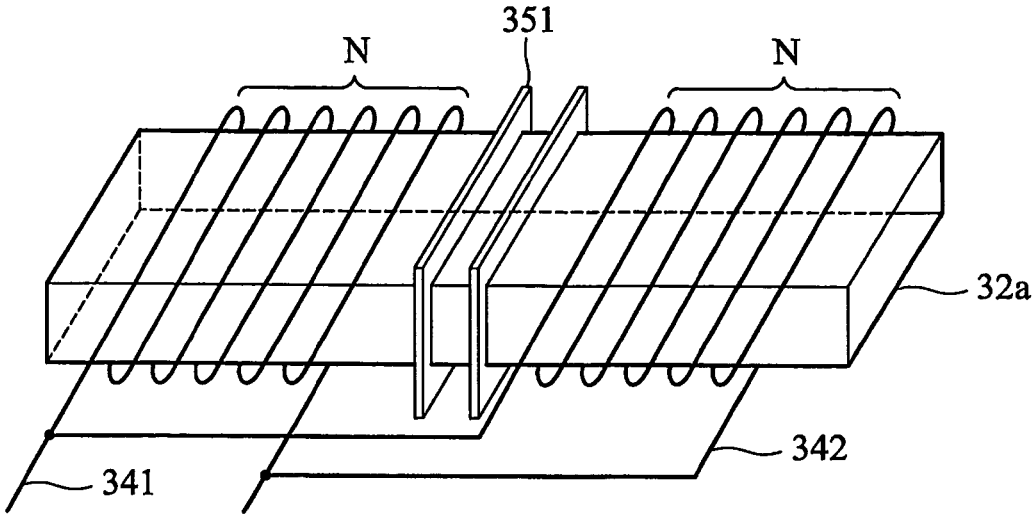
FIG. 11 shows another winding method of the first coil.

Only coil 341 is described herein as an example because coils 341 and 641 may be the same. FIG. 11 shows another winding method of the first coil. Two coils 341 and 342 are wound around the spindle 32*a*. A partition 351 partitions off the coils 341 and 342. The winding number of coil 341 equals that of coil 342.

Figure 12:
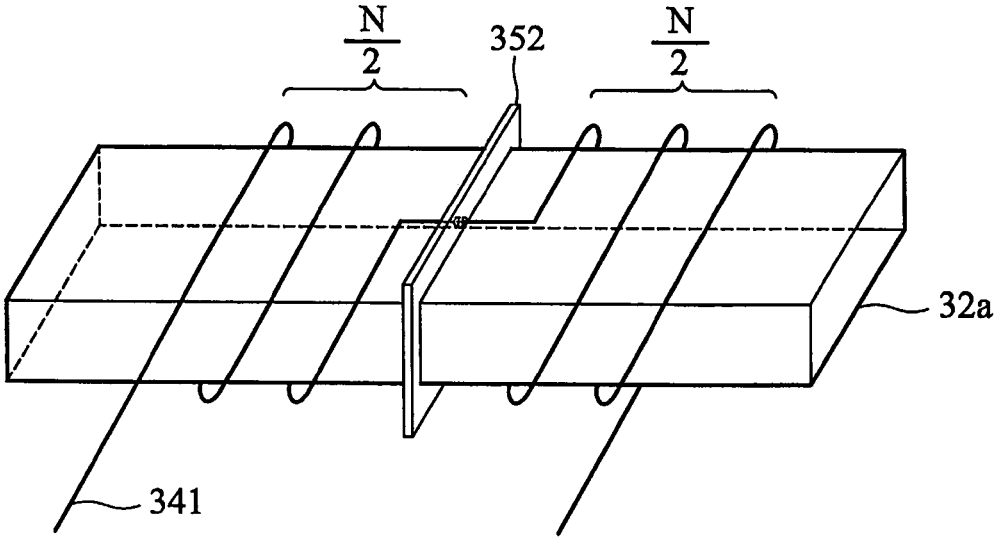
FIG. 12 shows another winding method of the first coil.

FIG. 12 shows another winding method of the first coil. The first spindle 32*a* only comprises a first coil 341. The winding of the first coil 341 on either side of the partition 352 is half of the total winding number thereof.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transformer comprising:

a first spindle comprising a first hollow portion;

a second spindle comprising a second hollow portion and arranged in parallel with the first spindle;

a first coil wound around the first spindle;

a plurality of independent second coils wound around the second spindle, wherein windings of each the second coils are approximately equal and the number of the second coils is even, wherein each the second coil has two terminal; and a core module disposed in the first and second hollow portions.

2. The transformer as claimed in claim 1, wherein every pair of second coils is spaced a specific distance apart.

3. The transformer as claimed in claim 1, further comprising a plurality of partitions, each disposed on the second spindle between every pair of second coils.

4. The transformer as claimed in claim 1, further comprising a third coil is wound around the first spindle and the separated from the first coil by a partition.

5. The transformer as claimed in claim 1, further comprising a partition disposed on the first spindle, wherein the winding of the first coil on either side of the partition is half the total winding thereof.

* * * * *